US007175021B2

(12) United States Patent
Colombo

(10) Patent No.: US 7,175,021 B2
(45) Date of Patent: Feb. 13, 2007

(54) HIGHLY ABSORBENT OPEN CELL POLYMER FOAM AND FOOD PACKAGE COMPRISED THEREOF

(75) Inventor: Edward A. Colombo, Penfield, NY (US)

(73) Assignee: Commodore Machine Co. Inc., Bloomfield, NY (US)

( * ) Notice: Subject to any disclaimer, the term of this patent is extended or adjusted under 35 U.S.C. 154(b) by 377 days.

(21) Appl. No.: 10/744,965

(22) Filed: Dec. 23, 2003

(65) Prior Publication Data

US 2004/0195115 A1 Oct. 7, 2004

Related U.S. Application Data

(63) Continuation-in-part of application No. 10/300,256, filed on Nov. 20, 2002, now Pat. No. 6,695,138.

(51) Int. Cl.
*B65D 81/26* (2006.01)

(52) U.S. Cl. ..... 206/204; 206/557; 426/124; 426/129; 428/36.5

(58) Field of Classification Search ..... 206/204, 206/205, 213.1, 557, 564; 229/406, 407; 426/124, 129; 428/36.5
See application file for complete search history.

(56) References Cited

U.S. PATENT DOCUMENTS 5,720,999 A 2/1998 Lanzani et al.
5,833,894 A 11/1998 Lanzani et al.
6,045,622 A * 4/2000 Holt et al. ..... 134/6
6,093,751 A 7/2000 Federico et al.
6,152,295 A 11/2000 Brander et al.
6,216,855 B1 * 4/2001 Grone ..... 206/204
6,235,360 B1 5/2001 Lanzani et al.
6,257,401 B1 7/2001 Mangla et al.
6,274,232 B1 8/2001 Otten et al.
RE37,780 E 7/2002 Lanzani et al.
6,695,138 B1 * 2/2004 Colombo et al. ..... 206/204

* cited by examiner

*Primary Examiner*—Mickey Yu
*Assistant Examiner*—Jerrold Johnson
(74) *Attorney, Agent, or Firm*—Patent Innovations LLC; John M. Hammond

(57) ABSTRACT

A highly absorptive open cell foam having a ratio of cell size to pore size of between about 1 and about 10. A juice absorbing food package comprising a tray having a bottom bounded by an upwardly extending lip around the perimeter of the bottom and a liquid-absorbing pad comprised of polymer foam joined to the bottom of said tray, wherein the polymer foam is a highly absorptive open cell foam having a ratio of cell size to pore size of between about 1 and about 10. The tray of the juice-absorbing package may be overwrapped with gas permeable film, and may be provided with an oxygen absorbing substance therein. Alternatively, the overwrapped tray may be placed in a sealed barrier bag that is subsequently purged with a non-oxidizing gas such as carbon dioxide.

21 Claims, 14 Drawing Sheets

HIGHLY ABSORBENT OPEN CELL POLYMER FOAM AND FOOD PACKAGE COMPRISED THEREOF

CROSS REFERENCE TO RELATED PATENT APPLICATION

This application is a continuation-in-part of application U.S. Ser. No. 10/300,256, filed Nov. 20, 2002, now U.S. Pat. No. 6,695,138.

This invention relates in one embodiment to highly absorbent open cell foams and more particularly to disposable and/or recyclable packaging trays for retail sale of food at supermarkets, grocery stores, delicatessens, and the like; and to the packaging of juice-containing meats and poultry products for sale in such establishments.

DISCLOSURE OF PARTIES TO A JOINT RESEARCH AGREEMENT

The invention claimed herein was made subject to and as a result of a joint research agreement between the parties Commodore Machine Co. of Bloomfield N.Y., and Edward A. Colombo of Fairport N.Y.

FIELD OF THE INVENTION

Open cell foam compositions and containers made therefrom for packaging, preservation, and display of juice-containing foods at retail sales locations.

BACKGROUND OF THE INVENTION

Sales of juice-containing foods, particularly meats, packaged in individual trays are common in supermarkets, grocery stores, and delicatessens. It is common to package such foods in solid polymer pouches and bags, solid polymer trays, laminated solid polymer trays, open and closed cell polymer foam trays and laminated open and closed cell polymer foam trays. The gaseous atmosphere within these different tray-packaging systems can be varied to extend the shelf life of the juice containing products. Examples of several different packaging methods are described in United States patents or published applications U.S. Pat. Nos. 6,602,590, 6,248,380, 5,989,613, 4,642,239, 3,574,642, 20030108643A1, W003076299A1; and European patent EP0729900B1. The disclosures of each of these patents or published applications is incorporated herein by reference.

While these various packaging systems provide various degrees of shelf life extension, all of these packaging systems require a means to absorb juices contained in the food product. One popular choice for a food packaging tray is a foamed polymer tray since such foam trays are lightweight, structurally strong, inexpensive, and sanitary. Such containers also are shaped to be nested closely to each other, so that a large number of containers can be shipped in a small volume shipping box.

However, while such foam trays are effective at containing juices leaked from meat held therein, if maintained in a substantially level orientation, they are not suitable for absorbing leaked juices. Such foam trays are typically made from closed-cell polymer foam, which is not wet by water and water-based juices. In addition, there is no pathway for juices to enter the void volume of the cells of such polymer foam, as the cells are closed and impermeable to water.

Absorbent open cell polymer foams are known, but a food tray formed of such open cell foam is unsatisfactory, because juices will leak through the foam wall, discolor the inside of the tray and escape from the container, and also, such open cell foam is not as structurally strong as closed cell foam. Alternatively, the practice of placing an absorbent fabric pad between the foam tray and the meat is practiced, but such practice is also unsatisfactory. Examples of such absorbent pads comprising fabric and/or fibers are provided in U.S. Pat. No. 5,320,895 of Larsonneur et al, and U.S. Pat. No. 6,278,371 of Hopkins, the disclosures of which are incorporated herein by reference. When customers examine and inspect the meat by holding and manipulating the tray, such meat may slide within the tray, and the proper orientation of the pad and the meat may be disrupted. Additionally these fabric pads release absorbed juices when subjected to physical pressure by the consumer and so do not provide for a consumer acceptable product.

There is also the practice of simply packaging meat in such closed cell trays with no absorptive pad, but such practice is also unsatisfactory. When customers examine and inspect the meat by holding and manipulating a non-absorbing tray, and orient the tray vertically, the juice contained therein may leak out at the junction of the edge of the tray and the stretch-wrap film applied around the tray. In addition, the visual appearance of the blood-red juices flowing within the tray during inspection may provide a negative impression on the consumer.

In many circumstances, a package comprising a tray with a liquid absorbing pad joined to the bottom thereof will provide satisfactory results when used in the packaging of meat. However, in some instances, the absorbent tray is packaged with food product (meat for example) and immediately placed into a corrugated container for shipping. The finished tray containing the food product is placed into the corrugated shipping container at an angle greater than zero (and typically between about 45 degrees and about 70 degrees) from the horizontal in order to utilize the maximum amount of space within the corrugated shipping container. Under these conditions, trays that do not absorb food purge or juices quickly enough are unsatisfactory for such use where the finished trays are quickly placed in a shipping container at an angle. In such circumstances, some significant portion of the food purge or juices accumulate at the bottom edge of the absorbent tray as such tray rests in the shipping container.

Such a tray, which does not absorb food purge or juices quickly enough is unsatisfactory for use because during shipping (and/or prior to the contents being frozen), there is some risk that the juices will leak out of the package, causing messy and unsanitary conditions in the shipping container. Also, at such time when the package is placed in a display case for retail sale, it will have an unsatisfactory appearance. Like many consumer products, a decision to purchase a food is often made based on both visual appeal and practical considerations. Thus there is a need for a meat package, which has very rapid juice absorbing properties, and which will retain juice from meat contained therein during handling, and during transportation of the meat to the display location, the checkout/purchase counter, and to the customer's home, even when such a package is placed at an angle shortly after packaging, and at various times thereafter. To provide such a meat package, there is a need to modify the nature of the open cell absorbent pad to more quickly absorb the meat purge in a vertical or nearly vertical position.

It is therefore an object of this invention to provide a simple, inexpensive food package with rapid juice absorbing capability.

It is therefore an object of this invention to provide a simple, inexpensive food package that will retain absorbed juices when such package is placed at an angle other than horizontal.

SUMMARY OF THE INVENTION

In accordance with the present invention, there is provided a highly absorptive open cell polymer foam having a ratio of cell size to pore size of between about 1 and about 4, wherein said polymer foam is compromised of between 50 to about 90 percent open cells; said polymer foam has an average cell diameter of between about 1 and about 10 thousandths of an inch; said polymer foam has a ratio of cell size to pore size of about 1 to about 10; said polymer foam has a density of between 1 and about 20 pounds per cubic foot; and said polymer foam has a contact angle when placed with water of about 0 to 70 degrees.

In accordance with the present invention, there is further provided a food package comprising a tray having a bottom bounded by an upwardly extending lip around the perimeter of said bottom and a liquid-absorbing pad comprised of polymer foam joined to said bottom of said tray, wherein said polymer foam is compromised of between 50 to about 90 percent open cells; said polymer foam has an average cell diameter of between about 1 and about 10 thousandths of an inch; said polymer foam has a ratio of cell size to pore size of about 1 to about 10; said polymer foam has a density of between 1 and about 20 pounds per cubic foot; and said polymer foam has a contact angle when placed with water of about 0 to 70 degrees.

BRIEF DESCRIPTION OF THE DRAWINGS

The invention will be described by reference to the following drawings, in which like numerals refer to like elements, and in which:

FIG. 1A is a top view of a unitary closed cell foam tray of the prior art, used in packaging, and retail sale of meats, seafood, and the like;

Figure 1B:
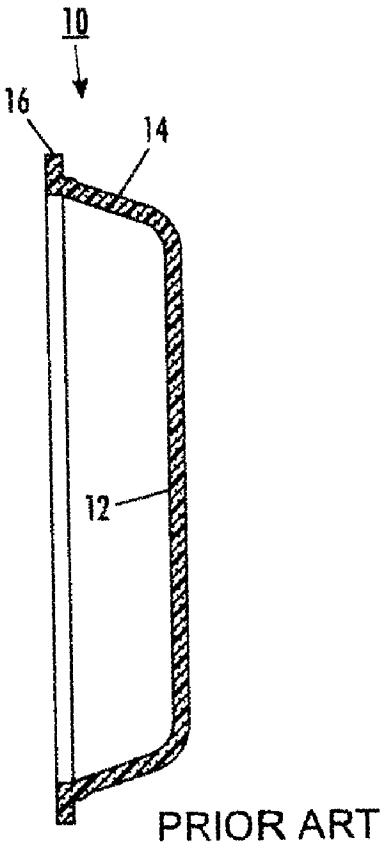
FIG. 1B is a sectional view of the closed cell foam tray of FIG. 1A, taken along line 1B—1B of FIG. 1A.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENTS

For a general understanding of the present invention, reference is made to the drawings. In the drawings, like reference numerals have been used throughout to designate identical elements.

Figure 1A:
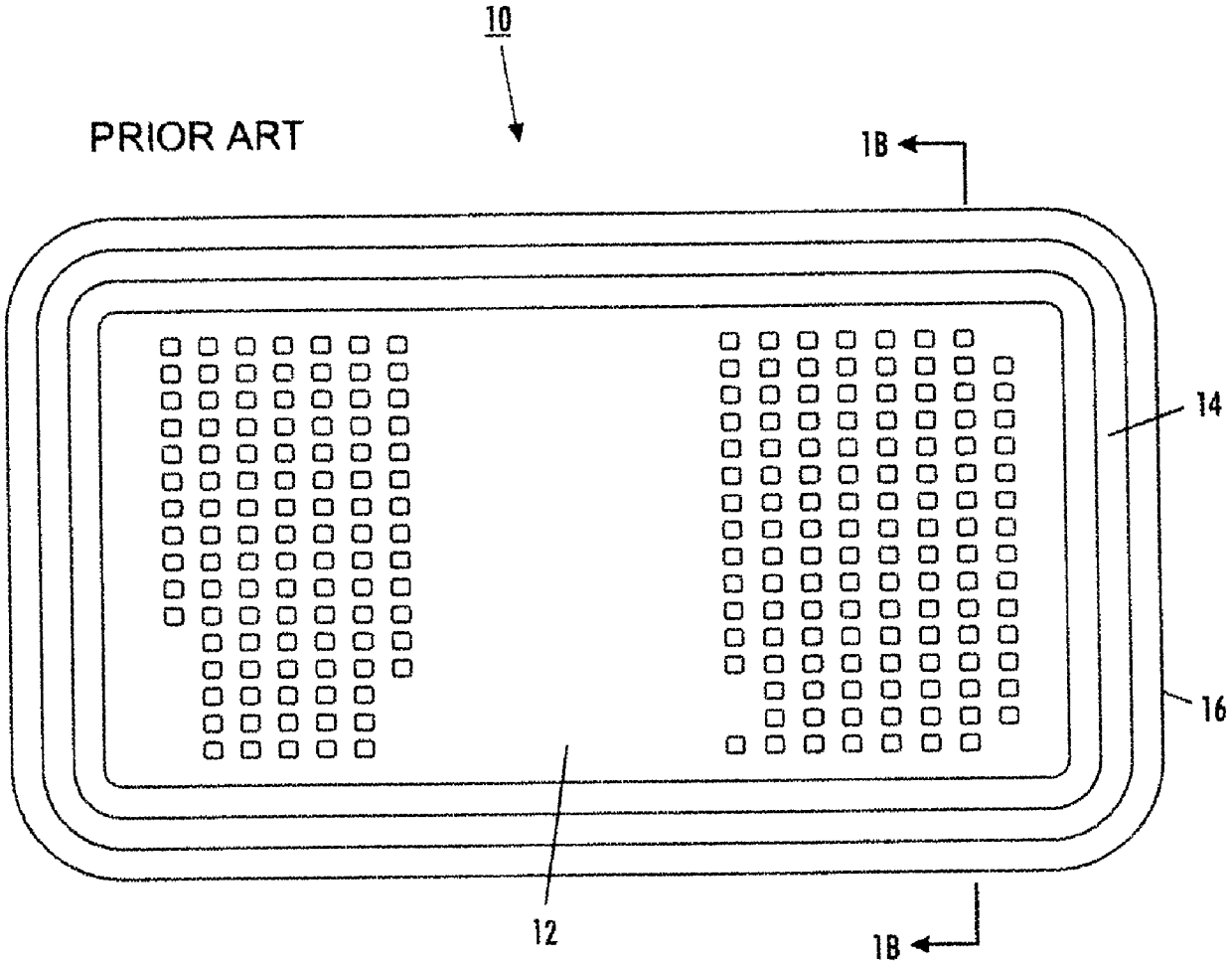

FIG. 1A is a top view of a unitary closed cell foam tray of the prior art, used in packaging, and retail sale of meats, seafood, and the like. FIG. 1B is a sectional view of the closed cell foam tray of FIG. 1A, taken along line 1B—1B of FIG. 1A. Referring to FIGS. 1A and 1B, foam tray 10 comprises a substantially flat bottom 12, bounded by an upwardly extended lip 14 around the entire perimeter 16 thereof. In use, a food product (not shown) such as, e.g. a piece of meat, poultry, or fish is placed upon bottom 12 of tray 10, tray 10 is typically fully wrapped with clear stretch wrap film (not shown), thereby enclosing the food therein. Juices leaked from such food are retained within tray 10 by lip 14, as long as tray 10 is maintained in a substantially horizontal position.

Figure 2B:
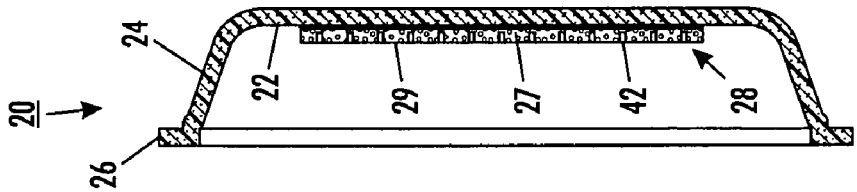
FIG. 2B is a sectional view of the juice-absorbing package of FIG. 2A, taken along line 2B—2B of FIG. 2A.
Figure 2A:
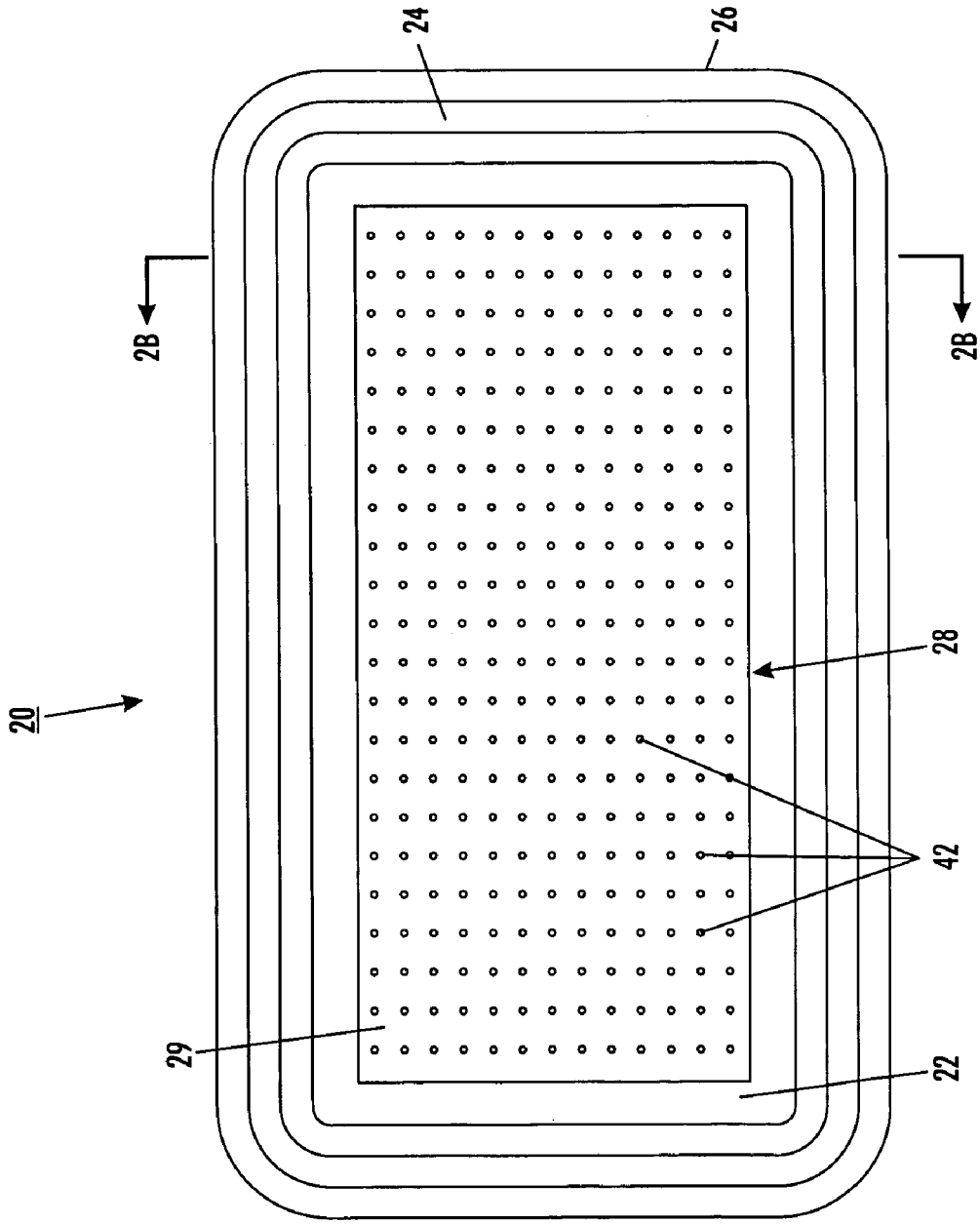
FIG. 2A is a top view of a first embodiment of the juice-absorbing package of the present invention.

FIG. 2A is a top view of a first embodiment of the juice-absorbing package of the present invention. FIG. 2B is a sectional view of the juice-absorbing package of FIG. 2A, taken along line 2B—2B of FIG. 2A. Referring to FIGS. 2A and 2B, juice-absorbing package 20 comprises a substantially flat bottom 22 bounded by an upwardly extended lip 24 around the entire perimeter 26 thereof, and a juice absorbing pad 28 suitably joined to the bottom 22 of tray 20. Juice absorbing pad 28 may be joined to the bottom 22 of tray 20 by a suitable liquid or molten adhesive (not shown) applied to bottom 22, prior to engagement with pad 28, or by application of adhesive (not shown) around the perimeter 30 of pad 28, or by heat seal means, or by application of a double sided adhesive tape (not shown) to bottom 22 of tray 20, or to the underside of pad 28, prior to the engagement of pad 28 with bottom 22 of tray 20.

In a further embodiment, juice absorbing pad 28 may joined to the bottom 22 of tray 20 by lamination to bottom 22 of tray 20. Such lamination may be done by a laminating machine that laminates a pad 28 that covers at least a substantial portion of tray 20, and preferably the entire bottom 22 of tray 20, before or during the formation of tray 20 from the raw sheet polymer foam from which tray 20 is formed.

In one preferred embodiment, juice-absorbing pad 28 is made of a wafer of hydrophilic open cell foam, such that it is wettable, and absorbs water. In one more preferred embodiment, such open cell foam wafer is made from a resin selected from the group consisting of polyethylene, polyvinyl chloride, polyacrylonitrile (such as the "BAREX" resin sold by the British Petroleum/Amoco company), poly(ethylene terephthalate), polystyrene, rubber-modified polystyrene, Kraton Polymers supplied by Kraton, ethylene vinyl acetate(EVA),mixtures of polystyrene and EVA, ethylene-polystyrene, interpolymers (such as "INDEX" interpolymers sold by Dow Chemical Corporation of Midland Mich.), polypropylene, polyurethane, polyisocyanurate, epoxy, urea formadehyde, rubber latex, silicone, fluropolymer or copolymers thereof or blends thereof.

In one embodiment, depicted in FIGS. 2A and 2B, juice absorbing pad 28 comprises an upwardly disposed impermeable surface 29 having a plurality of perforations 42 disposed therethrough. When juices leak from a piece of food (not shown), that is placed within juice absorbing package 20 upon surface 29, such juices flow through perforations 42, and are absorbed by the porous open cell inner core 27 of pad 28.

In a further embodiment, juice-absorbing pad 28 is joined to the bottom 22 of tray 20 by use of a solvent that will partially dissolve or soften both tray 20 and juice absorbing pad 28. With the mating surfaces of tray 20 and juice absorbing pad 28 partially dissolved and in a liquid or plastic state, when such surfaces of tray 20 and juice absorbing pad 28 are engaged with each other, a strong bond there between is provided after the evaporation of the solvent occurs. In one example of such an embodiment, a tray of polystyrene closed cell foam was bonded to a wafer of water absorbing polystyrene open cell foam with 70% open cells by the use of a mixture of ortho-, meta-, and para- xylenes. Other suitable bonding solvents include acetone, and mixtures of xylenes and methyl alcohol, or similar solvents that at least partially dissolve polystyrene.

Figure 3B:
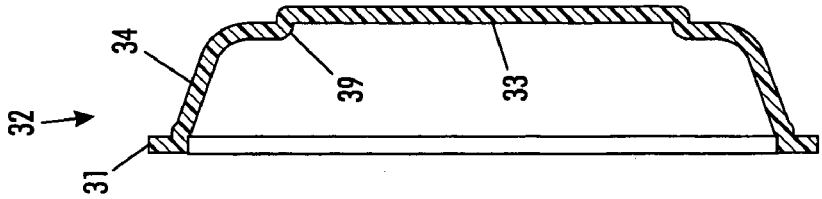
FIG. 3B is a sectional view of the juice-absorbing package of FIG. 3A, taken along line 3B—3B of FIG. 3A.
Figure 3A:
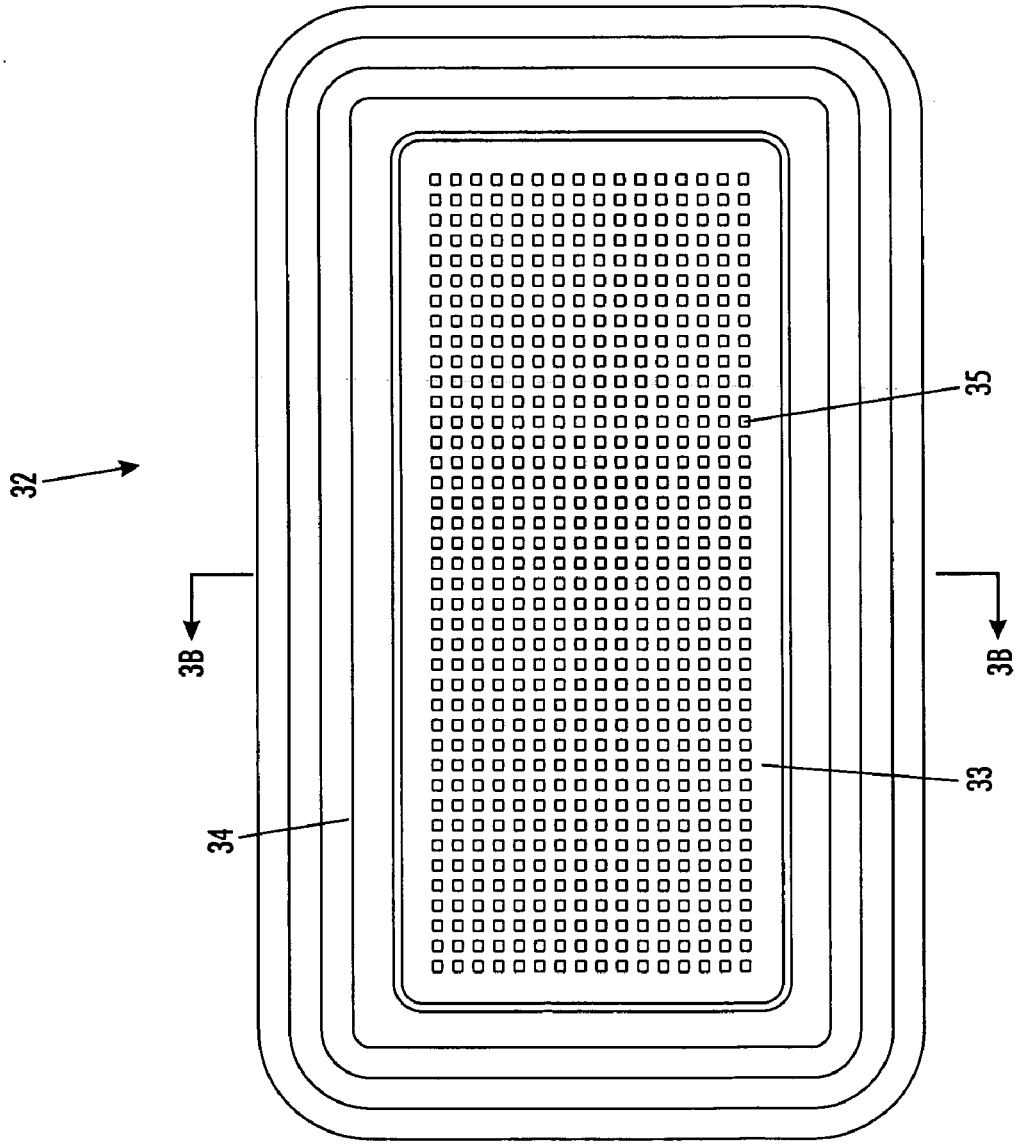
FIG. 3A is a top view of a closed cell foam tray that is used as one part of the juice-absorbing package of the present invention.

FIGS. 3A–6B depict aspects of a more preferred embodiment of applicants' juice absorbing package, in unassembled and assembled states. FIG. 3A is a top view of a preferred foam tray that is used as the main container of applicants' preferred juice absorbing package. FIG. 3B is a sectional view of the juice-absorbing package of FIG. 3A, taken along line 3B—3B of FIG. 3A. Referring to FIGS. 3A and 3B, foam tray 32 comprises a substantially flat bottom 33, bounded by an upwardly extended lip 34 around the entire perimeter 31 thereof. In one embodiment, foam tray 32 comprises an array of indented or protruding dimples 35 disposed on bottom 33.

Figure 6B:
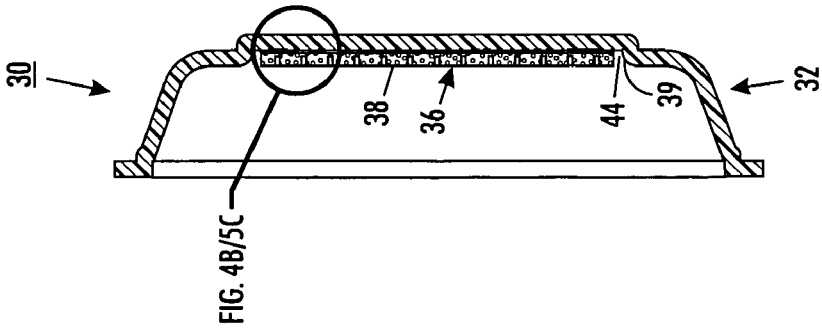
FIG. 6B is a sectional view of the juice-absorbing package of FIG. 6A, taken along line 6B—6B of FIG. 6A.

In the preferred embodiment, foam tray 32 further comprises a step 39 disposed around the perimeter of flat bottom 33, such that a substantially rectangular recessed or countersunk volume is formed within foam tray 32 by step 39 and flat bottom 33. This countersunk volume provides a space within tray for the placement of a juice absorbing pad therein as depicted in FIG. 6B, the details of which will be explained subsequently in this specification.

Figure 4A:
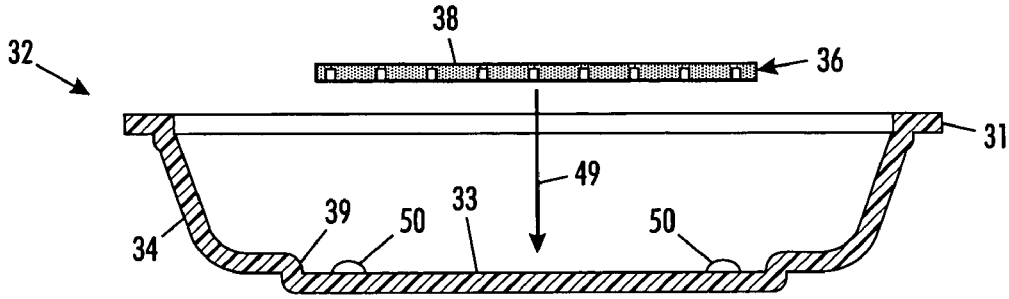
FIG. 4A is a sectional view of the tray of FIG. 3B, and a preferred juice absorbing pad, prior to assembly thereof to form a preferred juice absorbing package.

FIG. 4A is a sectional view of the tray of FIG. 3B, and a preferred juice absorbing pad, prior to assembly thereof to form a preferred juice absorbing package. Referring to FIG. 4A, juice-absorbing pad 36 comprises a porous open cell inner core 37 bounded by an intact smooth skin 38 on one side, and a perforated smooth skin 40 on the other side. In the preferred embodiment, juice absorbing pad 36 is joined to foam tray 32 with the perforated skin 40 positioned adjacent to bottom 33 of tray 32. Juice absorbing pad 36 is preferably joined to foam tray 32 by a plurality of adhesive dots 50.

Figure 4B:
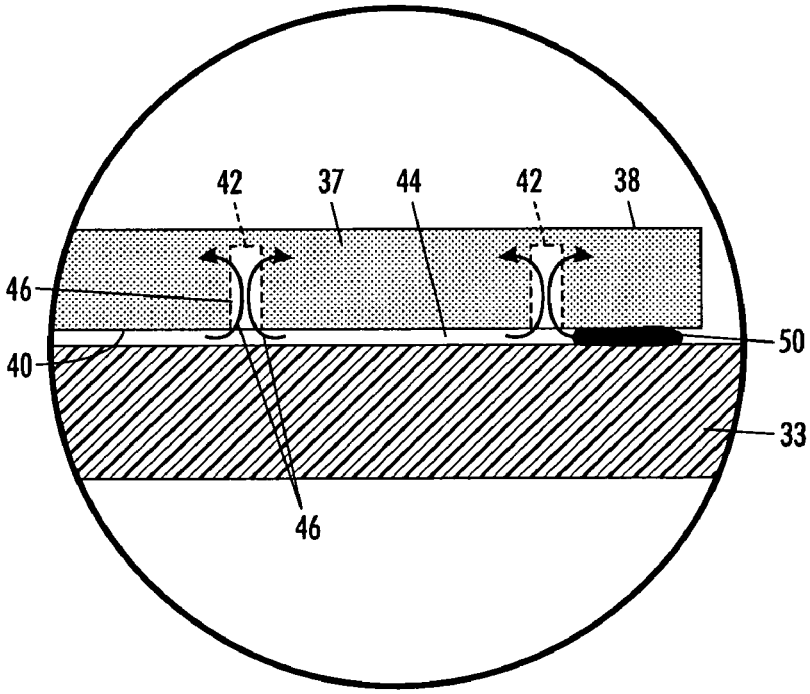
FIG. 4B is a detailed view of a portion of the juice absorbing pad and tray bottom depicted in the sectional view of FIG. 6B, after the juice absorbing pad and tray have been assembled together
Figure 5A:
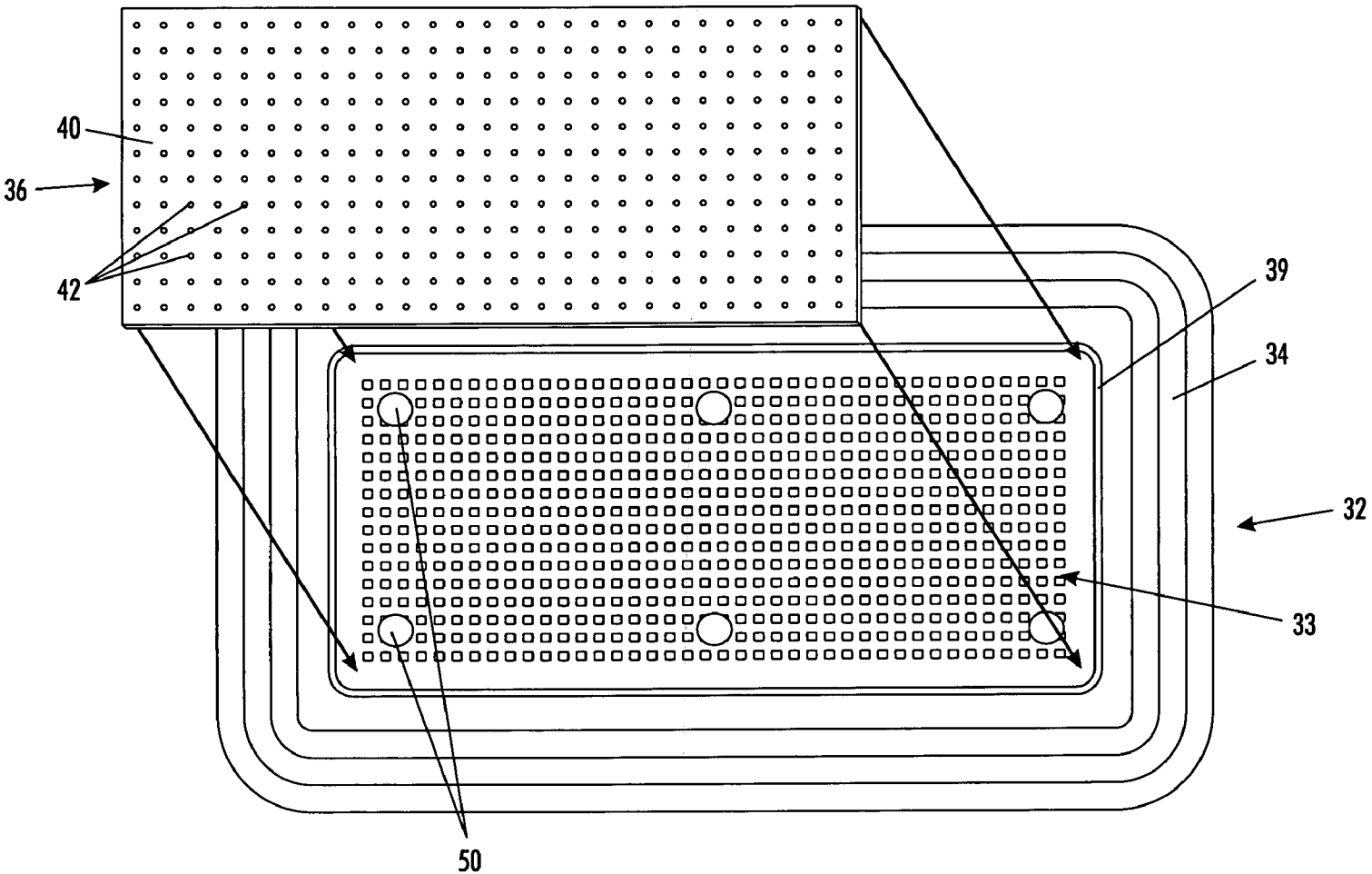
FIG. 5A is a top view of a first embodiment of the foam tray and juice absorbing pad of FIG. 4, prior to assembly.

FIG. 5A is a top view of a first embodiment of the foam tray and juice absorbing pad of FIG. 4, prior to assembly. Referring to FIG. 5A, juice absorbing pad 36 is depicted with perforated side 40 facing upward, thereby showing an array of perforations 42 disposed through perforated side 40. FIG. 5A further depicts a plurality of adhesive dots 50 having been applied immediately prior to assembly of juice absorbing pad 36 with tray 32.

Adhesive dots 50 preferably comprise a liquid adhesive. In one embodiment, foam tray 32 comprised polystyrene closed cell foam, juice absorbing pad comprised open cell polystyrene foam having at least 70 percent open cells, and adhesive dots 50 comprised a low molecular weight polyethylene hot-melt adhesive applied with a hot-melt glue gun. Other adhesives, which suitably adhere to the juice absorbing pad 36 and foam tray 32, and which are inexpensive, easy to apply, and meet FDA and USDA requirements may be suitable. In one embodiment, it is preferred that adhesive dots 50 are elastic, after such dots are fully cured.

In the embodiment shown in FIG. 5A, adhesive dots 50 are applied to the bottom 33 of tray 32. It will be understood that alternatively, adhesive dots 50 may be applied to perforated side 40 of juice absorbing pad 32. In either case, after application of a plurality of adhesive dots 50, assembly of juice absorbing pad 36 to tray 32 is performed by turning perforated side 40 of juice absorbing pad 36 toward bottom 33 of tray 32, and pressing juice absorbing pad 36 against bottom 33 of tray 32, as indicated by arrow 49 of FIG. 4A.

Figure 5B:
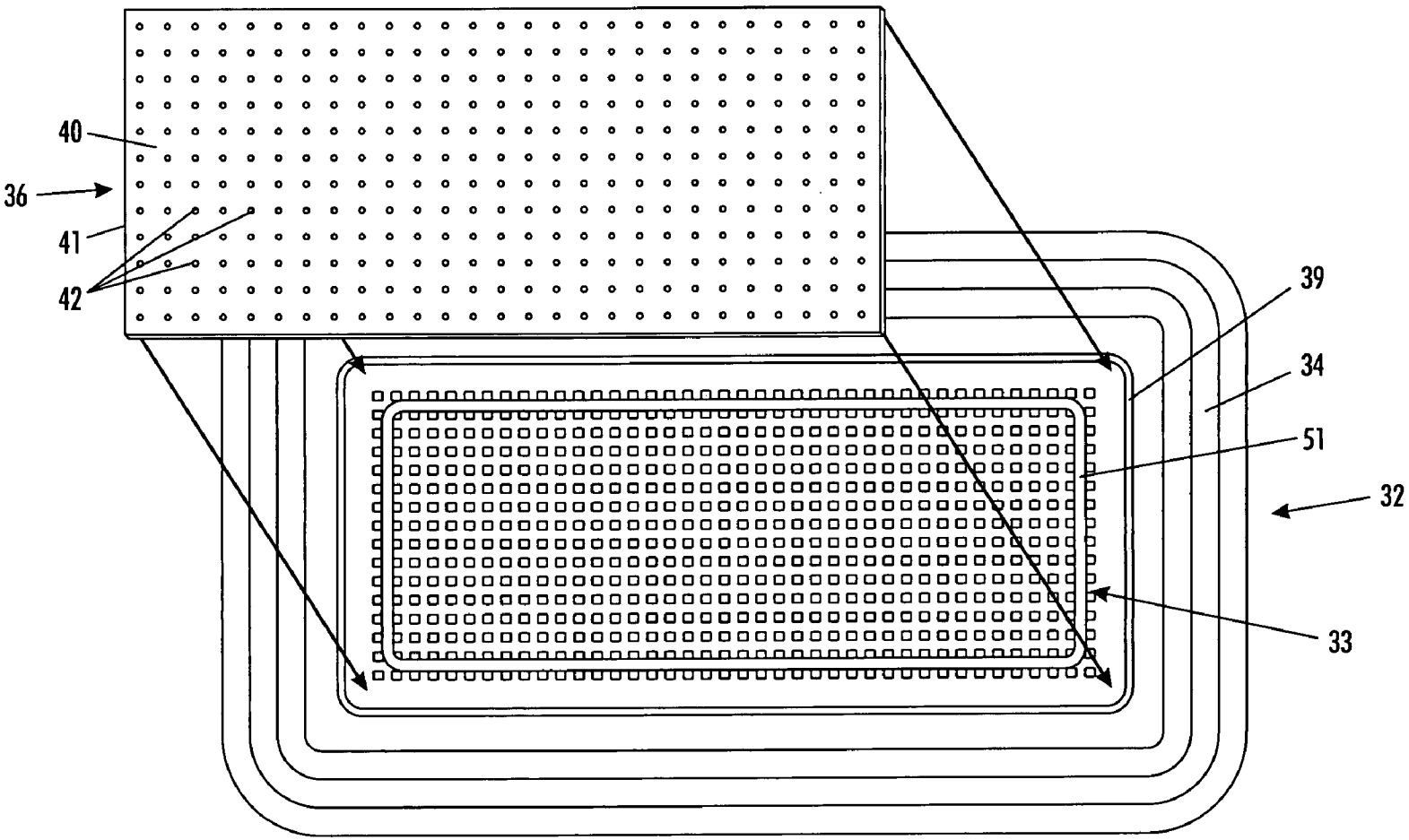
FIG. 5B is a top view of a second embodiment of the foam tray and juice absorbing pad of FIG. 4, prior to assembly.

FIG. 5B is a top view of a second embodiment of the foam tray and juice absorbing pad of FIG. 4, prior to assembly. The embodiment of FIG. 5B is similar to the embodiment described and shown in FIG. 5A, with the exception being that instead of dots of adhesive being used to join pad 36 to tray 32, a continuous bead 51 of adhesive is disposed near the perimeter of bottom 33 of tray 32, formed by step 39. Thus when pad 36 is assembled to tray 32 with perforated side 40 toward bottom 33 of tray 32, interstice 44 (see FIG. 4B) is entirely sealed beneath pad 36, and the height of interstice 44 is defined by the thickness of cured bead 51 of adhesive. Such a continuous bead 51 of adhesive is preferably applied to bottom 33 of tray 32 within between about 0.25 inches and about 0.5 inches of step 39 of tray 32.

Figure 5C:
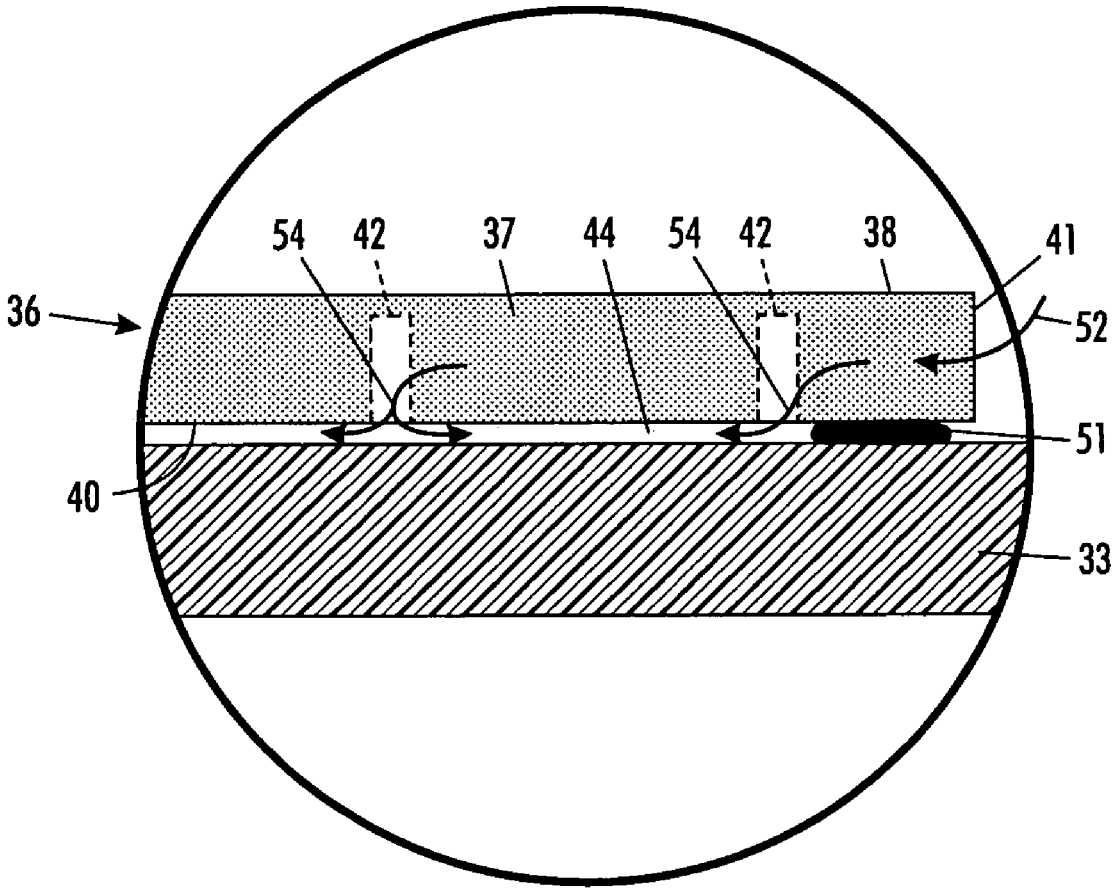
FIG. 5C is a detailed view of a portion of the juice absorbing pad and tray bottom depicted in FIG. 5B and in the sectional view of FIG. 6B, after the juice absorbing pad and tray have been assembled together.

The sealing of interstice 44 beneath pad 36 is advantageous in certain applications of applicants' juice absorbing package. FIG. 5C is a detailed view of a portion of the juice absorbing pad and tray bottom depicted in FIG. 5B and in the sectional view of FIG. 6B, which depicts the phenomena providing such an advantage. Referring to FIG. 5C, juices are prevented from wicking into interstice 44 beneath pad 36 around the perimeter thereof by bead 51 of adhesive, which is disposed beneath and slightly inside of perimeter 41 of pad 36. However, in this embodiment, juices collected in trench 44 formed between perimeter 41 of pad 36 and step 39 of tray 32 (see FIGS. 6A and 6B) wick into pad 36 through the porous, unsealed perimeter 41 of pad 36, as indicated by arrow 52. Subsequently, juices wick further into pad 36, and when the open cells of pad 36 approach saturation, juices flow out through perforations 42, and into interstice 44, as indicated by arrows 54. Thus, in this embodiment, the provision of a sealing bead 51 of adhesive disposed substantially around the perimeter 41 of pad 36 results in interstice 44 functioning as a compartment that holds additional juices in addition to what pad 36 absorbs.

Through experimentation, applicants have determined ranges of package component properties, which provide acceptable juice absorbing packages and are thus to be considered within the scope of the present invention. Referring to FIGS. 4A–6B, juice absorbing pad 36 is preferably between about 20 mils and about 300 mils thick, depending upon the size and juice content of the food to be packaged, one mil being equal to one one-thousandth (0.001) of an inch. Juice absorbing pad 36 is preferably comprised of open cell foam comprising between about 20 percent and about 90 percent open cells, the open cells thereof containing air comprising about 21 percent oxygen, prior to performing any packaging step that dilutes, purges, or absorbs such oxygen. Such open cell foam preferably comprises open cells having an average diameter of between 1 and 10 mils.

Such open cell foam preferably has a density of between about 1 and about 20 pounds per cubic foot, and such open cell foam preferably has a contact angle of from about zero to about 70 degrees when placed in contact with water. In one preferred embodiment, such open cell foam preferably further comprises from about 0.5 percent to about 15 percent by weight of surfactant, which renders such foam hydrophilic, thereby enhancing juice absorption of such foam.

One measure of the extent to which such foam is made hydrophilic is the contact angle of water upon a cast film of the surfactant-containing polymer comprising such foam. Such contact angle is customarily defined as the angle between the surface of a liquid and the surface of a partially submerged object, or of a container holding the liquid, at the line of contact. In the preferred embodiment, the contact angle of water upon the surfactant-containing polymer film comprising such foam is between about 0 and about 70 degrees.

Referring to FIGS. 5A–6B, the distance between the edge 41 of juice absorbing pad 36 and the step 39 of tray 32 (i.e. the width of trench 44) is between about 0.001 inches and about 0.250 inches, preferably between about 0.025 inches and about 0.125 inches, and more preferably between about 0.040 inches and about 0.080 inches. The interstice 44 between bottom 33 of tray 32 and underside 40 of pad 36 is determined by the cured thickness of adhesive dots 50 or adhesive bead 51, in embodiments in which adhesive is used. In such embodiments interstice 44 is between about 0.001 and about 0.075 inches, preferably between about 0.010 inches and about 0.050 inches, and more preferably between about 0.015 inches and 0.020 inches. In embodiments in which no adhesive is used, e.g. where solvent is used to partially dissolve some area of bottom 33 and underside 40 of pad 36, and then pressing underside 40 of pad 36 against bottom 33, as previously described, interstice 40 is approximately 0.000 inches to about 0.020 inches, the upper limit being determined by the deviation of bottom 33 of tray 32 and/or underside 40 of pad 36 from absolute flatness when such parts are joined together.

In a further embodiment (not shown), pad 36 is made with a serrated edge at perimeter 41, which provides more surface area around perimeter 41. Such additional surface area increases the rate at which pad 36 absorbs juices released by the food contained in the juice absorbing package. Such a serrated edge may be provided by cutting pad 36 using a toothed knife, which preferably has between 10 and 100 teeth per inch of cutting edge thereof.

Figure 6A:
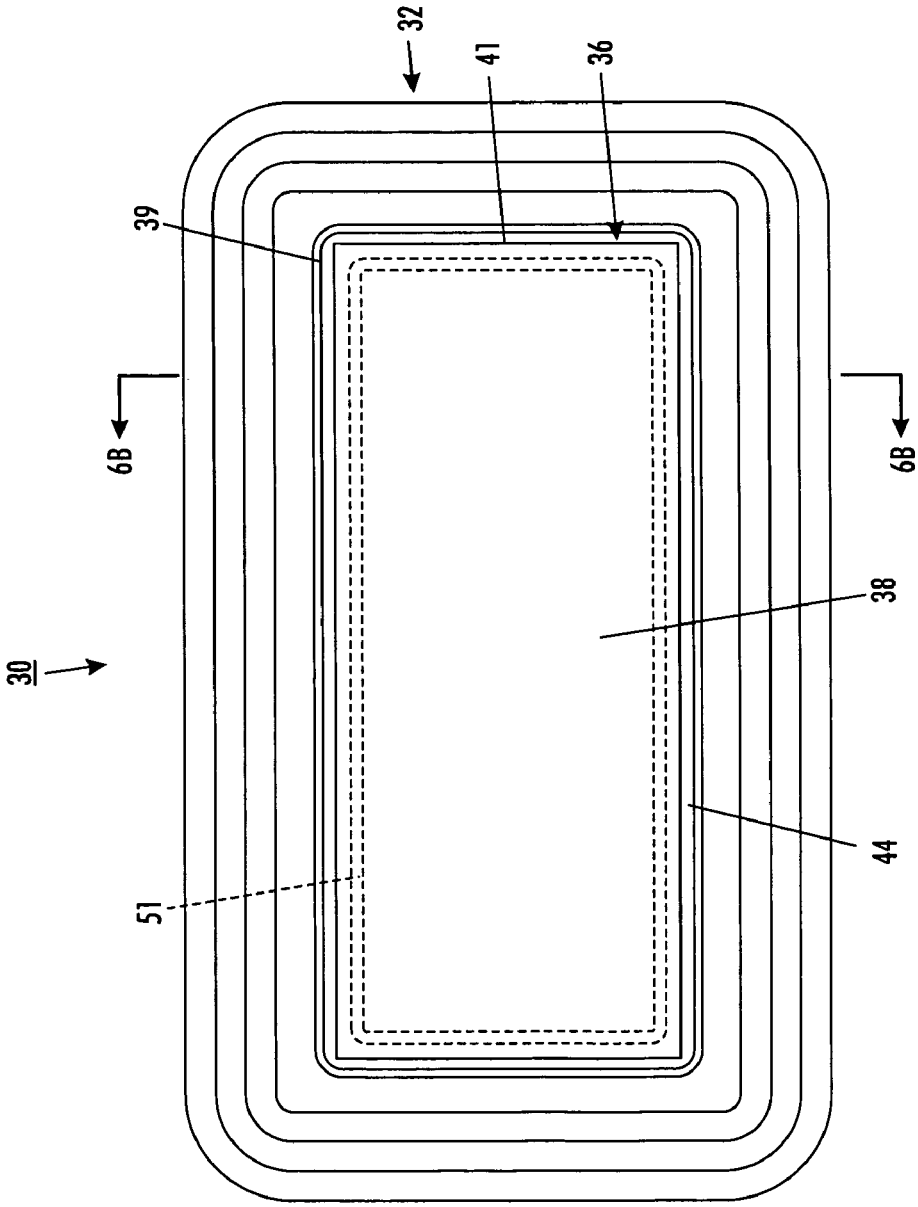
FIG. 6A is a top view of an assembled preferred embodiment of applicants' juice absorbing package.

FIG. 6A is a top view of an assembled preferred embodiment of applicants' juice absorbing package. FIG. 6B is a sectional view of the juice-absorbing package of FIG. 6A, taken along line 6B—6B of FIG. 6A. Referring to FIGS. 6A and 6B, juice absorbing package 30 comprises juice absorbing pad 36 joined to closed cell foam tray 32, with non-perforated side 38 of juice absorbing pad 36 facing outward. In use, a food product (not shown) such as, e.g. a piece meat or fish is placed upon non-perforated side 38 of juice absorbing pad 36, and juice absorbing package 30 is typically fully wrapped with clear stretch wrap film, thereby enclosing the food therein. When juices leak from such food, they flow into a small trench 44 formed between the perimeter 41 of juice absorbing pad 36 and the step 39 of bottom 33 of tray 32. Thus the use of a tray 32 with a countersunk bottom 33 formed by step 39 is preferable over the use of the simple, flat bottomed tray 26 of FIGS. 2A and 2B, because trench 44 is formed by step 39 of tray 32 and perimeter 41 of pad 36, thereby directing leaked juices into the perimeter 41 of pad 36, and/or into the interstice 44 beneath pad 36.

In addition, in the embodiment depicted in FIGS. 4B and 5A, leaked juices flow into interstice 44 between juice absorbing pad 36 and bottom 33, into perforations 42, and into porous open cell core 37 of pad 36, as indicated by split arrows 46. In this embodiment, applicants' juice absorbing package 30 (see FIG. 6) has a high juice absorbing rate, as well as capacity. Without wishing to be bound by any particular theory, applicant believes that when juice absorbing pad 36 is joined to the bottom 33 of tray 32 by use of dots 50 of elastic adhesive, such elastic adhesive may stretch, enabling juice absorbing pad 36 to separate slightly from the bottom 33 of tray 32, due to the effect of a buoyant force and possibly a capillary force. Accordingly, interstice 44 is increased under the influence of such force, and the rate at which juice is absorbed by pad 36 is enhanced. It will be apparent that the presence of perforations 42 in juice absorbing pad 36 is also important, in that such perforations enable the flow of juices into open cell core 37, through an otherwise impermeable smooth skin on pad 36.

In one embodiment of applicants' juice absorbing package comprising a foam tray, such tray is preferably a closed cell foam tray comprising at least about 50 weight percent polymer having at least about 90 percent closed cells with juice absorbing package further comprising a juice absorbing pad of open cell foam. In use, such a package would be used to package meat, being overwrapped or lidded with PVC film or other suitable stretch wrap. In one further embodiment, the foam material that is formed into such trays is coextruded or laminated with a thin surface oxygen barrier film that is fusible with such wrap, thereby enabling such wrap to be heat sealed to the foam tray, sealing the meat therein.

In one embodiment, juice absorbing pad 36 was made of open cell polystyrene foam, 0.25-inch thick, 4.6 inches wide, and 10.6 inches long, perforated on one side as shown in FIG. 5, and having a dry weight of 7.0 grams. Tray 32 was formed of material as described above, with a countersunk bottom having a step 39 0.25 inches high, a width of 4.8 inches, and a length of 10.8 inches, thereby forming a trench 44 approximately 0.1 inches wide and 0.25 inches deep for the collection of juices therein.

In an experiment, approximately 120 grams of water (the major constituent of meat juices) was poured into the juice absorbing package of FIG. 6, made with the 7.0 gram juice absorbing pad. It was visually apparent that the majority of such water was wicked into and absorbed by the juice absorbing pad. After one minute, the surplus water was poured from the tray, and the tray plus absorbed water was weighed. The juice absorbing pad absorbed 60.3 grams of water in one minute, i.e. more than eight times its weight, demonstrating sufficient juice absorbing capacity and absorption rate for effective use in a juice absorbing package.

Additionally or alternatively to the use of an open cell foam pad for juice absorption, in a further embodiment, one could use a single piece, pieces, or pellets of a super absorbent polymer, such as those described in U.S. Pat. No. 6,458,877, the disclosure of which is incorporated herein by reference.

The aforementioned embodiments of applicants' preferred juice absorbing package are superior to other prior art packages in additional ways. By having the meat, fish, or other food packaged therein resting on the non-perforated skin of the juice absorbing pad, such food is not excessively depleted of juice in the region of contact with the pad. This results in the food having more uniform cooking, texture, and taste properties when prepared and consumed. In addition, the manner in which the juice absorbing package wicks juices inwardly from along the perimeter of such pad, and hides such juices provides a more aesthetically pleasing package, which better promotes retail sale of the food therein. Additionally, by separating the juices from the meat product the possibility of bacterial contamination is reduced and product safety is enhanced.

In further embodiments, the applicants' juice absorbing package further comprises a bactericide. In one embodiment, such a bactericide is disposed throughout a portion or substantially all of the porous structure of the juice absorbing pad. In another embodiment, such a bactericide is disposed through a second pad or a piece fabric placed between the bottom of the tray and the juice absorbing pad.

The present invention is not limited to the use of a closed cell and/or gas impermeable foam tray as the main container of the juice absorbing package. In one further embodiment of applicants' juice absorbing package comprising a foam tray, such tray comprises at least 50 weight percent polymer comprising between about 20% and about 80% open cells. The foam of such tray is preferably without surfactant so that such tray is rendered hydrophobic, and will be substantially repellent and non-absorbing of leaked juices. Alternatively, the foam of such tray comprises at least about 50 weight percent hydrophilic polymer surfactant mixture comprising between about 20% and about 80% open cells. The juice absorbing pad of this embodiment preferably comprises open cell foam. In use, such a package would also be used to package meat, and overwrapped or lidded with PVC film or other suitable stretch wrap as described previously.

In another embodiment, applicants' juice absorbing package comprises a tray formed of a gas permeable solid resin, such as polypropylene, polystyrene, low-density polyethylene, amorphous poly(ethylene terephthalate), high-density polyethylene, and suitable mixtures thereof. The gas permeable solid trays may be laminated with a thin film of oxygen barrier material to render them useful in modified atmosphere packaging systems.

In other embodiments, the juice absorbing package of the present invention may be incorporated into other packaging having means to absorb, dilute, displace or control the concentration of oxygen therein. Such packaging is disclosed in applicant's U.S. Pat. Nos. 6,269,946, 6,269,945, 6,213,294, 6,112,890, 6,210,725, 6,023,915, and U.S. patent applications U.S. Ser. No. 09/906,280 and U.S. Ser. No. 10/280,034 the disclosures of which are incorporated herein by reference.

Thus, the previously described embodiments of the juice absorbing package comprising a closed cell foam tray, or an open cell foam tray without surfactant, or a gas-permeable solid resin tray, may be overwrapped or lidded with highly gas permeable film and placed in heat shrinkable barrier valve bag containing means for flowing a non-oxidizing gas such as carbon dioxide therein, as described in applicant's co-pending patent applications U.S. Ser. No. 10/280,034 and U.S. Ser. No. 09/906,280. Such a package would be advantageous in that it would provide juice absorbing capability, and an extended shelf life by reducing the exposure of the food packaged therein to oxygen.

In another embodiment having such advantages, the juice absorbing package comprising a closed cell foam tray, or an open cell foam tray without surfactant, or a gas-permeable solid resin tray, further comprises an oxygen absorber, disposed within such package, overwrapped, and placed in heat shrinkable barrier bag. The oxygen absorber may be a separate item, such as a packet comprising an oxygen absorbing material, such as iron powder. Such oxygen absorbing materials and packets are described in e.g., U.S. Pat. Nos. 6,436,872- 6,248,690, 6,156,231 of McKedy, the disclosures of which are incorporated herein by reference. Such oxygen absorbing packets are well known and are commercially available from suppliers such as e.g., Multisorb, Inc. of Buffalo, N.Y.

Figure 7A:
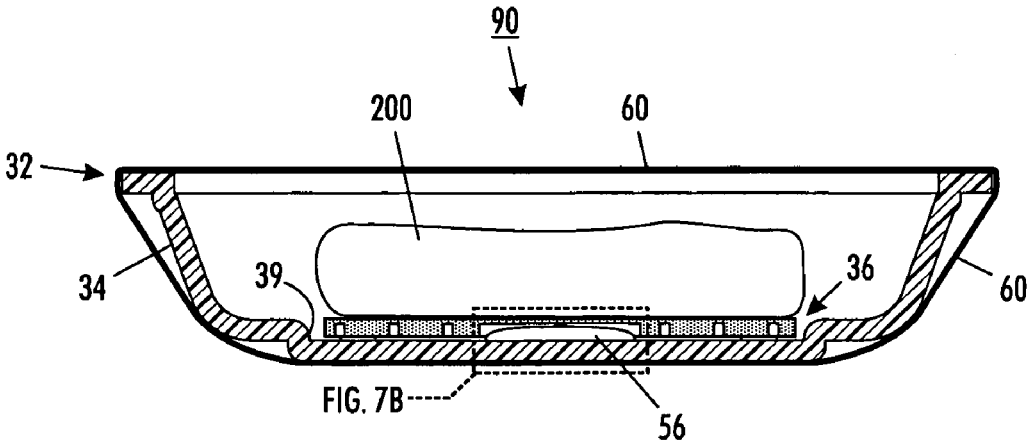
FIG. 7A is a sectional view of an embodiment of a juice and oxygen absorbing package comprising an oxygen absorbing packet.
Figure 7B:
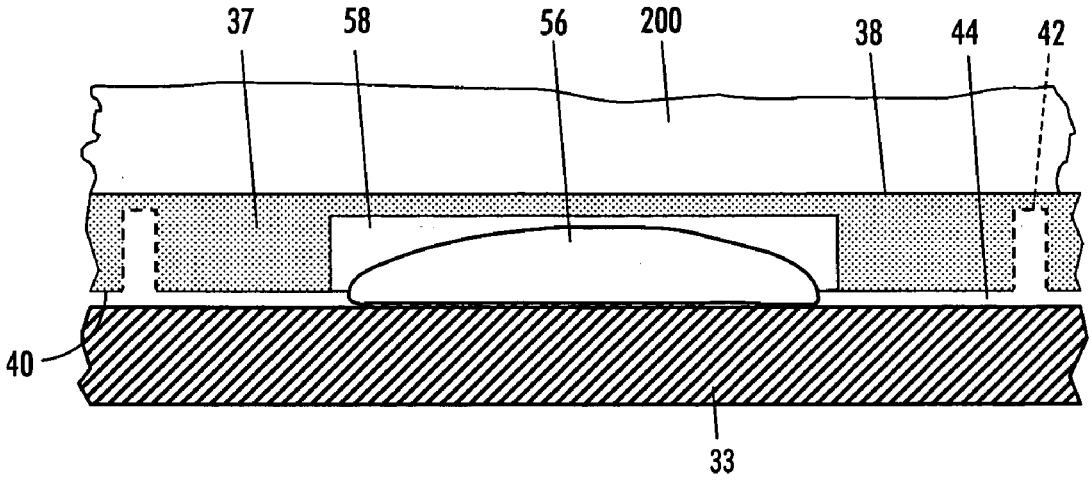
FIG. 7B is an enlarged detailed view of a portion of the juice and oxygen absorbing package of FIG. 7A, depicting the oxygen absorbing packet therein.

FIG. 7A is a sectional view of one preferred embodiment of a juice and oxygen absorbing package comprising an oxygen absorbing packet. FIG. 7B is an enlarged detailed view of a portion of the juice and oxygen absorbing tray of FIG. 7A, depicting the oxygen absorbing packet therein. Referring to FIGS. 7A and 7B, oxygen absorbing packet 56 is disposed in package 90, which is overwrapped by film 60. In the preferred embodiment, oxygen absorbing packet is disposed upon bottom 33 of tray 32, beneath juice absorbing pad 36, within a pocket 58 formed therein. Such a placement of oxygen absorbing packet provides for a more aesthetically pleasing appearance to the consumer.

In yet a further embodiment alternatively or additionally to an oxygen absorbing packet, the function of oxygen absorption is provided by an oxygen absorbing composition incorporated within or coated onto the tray, absorbent pad and/or film used as an overwrap or lid for the tray of the package. One suitable oxygen absorbing composition is comprised of an oxygen scavenging polymer as described in U.S. Pat. No. 6,455,620 of Cyr et al, the disclosure of which is incorporated herein by reference. Thus in the preferred embodiment of FIG. 7A, over-wrap 60, tray 32, and/or pad 36 further comprise an oxygen scavenging polymer, which reduces the exposure of the meat 200 contained within package 90 to oxygen, thereby increasing the shelf life of meat 200.

Figure 8:
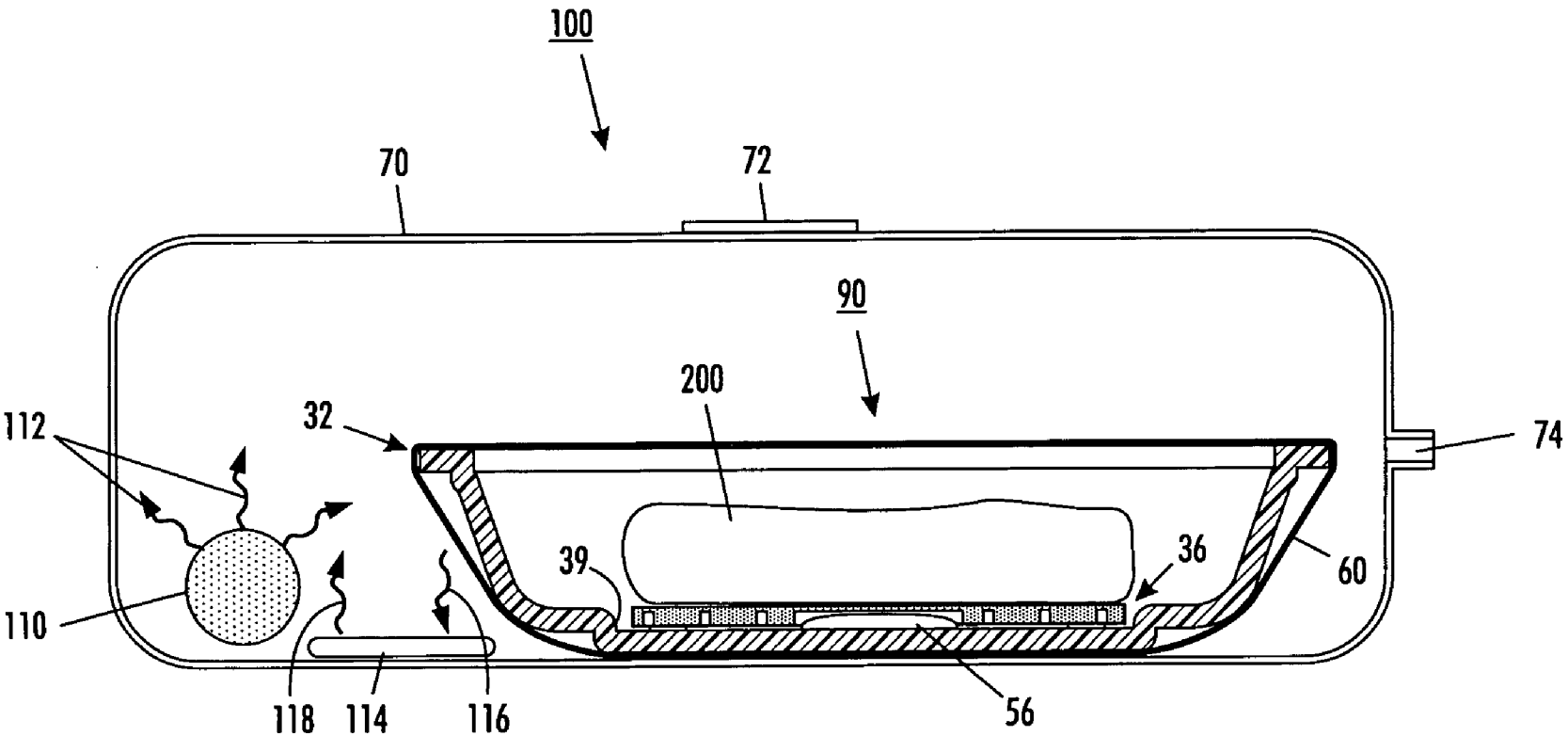
FIG. 8 is a sectional view of one preferred barrier packaging system for absorbing juice and absorbing and/or purging oxygen from the atmosphere therein, comprising the overwrapped juice and oxygen absorbing tray of FIG. 7A, disposed within a valved barrier bag.

FIG. 8 is a sectional view of one preferred barrier packaging system for absorbing juice and absorbing and/or purging oxygen from the atmosphere therein, comprising the overwrapped juice and oxygen absorbing tray of FIG. 7A, disposed within a valved barrier bag. Referring to FIG. 8, in one embodiment, the oxygen and juice absorbing package 90 is disposed through opening 74 in a heat shrinkable barrier bag 70 as described in applicant's pending U.S. patent application U.S. Ser. No. 10/280,034. The opening 74 of such barrier bag 70 is sealed, such barrier bag is heat-shrunk, and the atmosphere within bag 70 is evacuated through one-way valve 72, as described in applicant's aforementioned pending application and in applicant's U.S. Pat. Nos. 6,269,945, 6,269,946, 6,213,294, 6,112,890, and 6,210,725.

In another embodiment, alternatively or additionally to oxygen absorbing packet 56, a source of non-oxidizing gas is disposed within barrier bag 70. Referring again to FIG. 8, a piece 110 of solid carbon dioxide is disposed within barrier bag 70, prior to the sealing of opening 74. Subsequently, solid carbon dioxide piece 110 sublimes as indicated by arrows 112, purging the air therein, and providing a non-oxidizing atmosphere. Accordingly, the exposure of meat 200 contained in package 100 to oxygen is substantially eliminated, thereby greatly extending the shelf life of such meat prior to purchase.

In another embodiment, alternatively or additionally to solid carbon dioxide piece 110, a carbon dioxide producing sachet is disposed within barrier bag 70. Such sachets are well known and are commercially available from suppliers such as e.g., CO2 Technologies of West Des Moines Iowa. In the embodiment depicted in FIG. 8, sachet 114 is disposed within barrier bag 70, and when moisture diffuses into sachet 114 as indicated by arrow 116, carbon dioxide is produced by a chemical reaction, an is released into barrier bag 70, as indicated by arrow 118.

In another embodiment, tray 32 is provided with additional volume, and an additional compartment therein, in which the piece of solid carbon dioxide is disposed prior to the wrapping of tray 32 with film 60, and the sealing of package 90 in barrier bag 70, as described in the aforementioned applicant's patent U.S. Pat. No. 6,269,946.

As was described in the Background of the Invention in this specification, in some circumstances, an absorbent tray is packaged with meat and immediately placed into a container for shipping. The finished tray containing the food product is placed into the shipping container at an angle greater than zero (and typically about 45 degrees) from the horizontal in order to utilize the maximum amount of space within the corrugated shipping container. Under these conditions, trays that do not absorb food purge or juices quickly enough are unsatisfactory for such use where the finished trays are quickly placed in a shipping container at an angle. In such circumstances, some significant portion of the food purge or juices accumulate at the bottom edge of the absorbent tray as such tray rests in the shipping container.

Figure 9B:
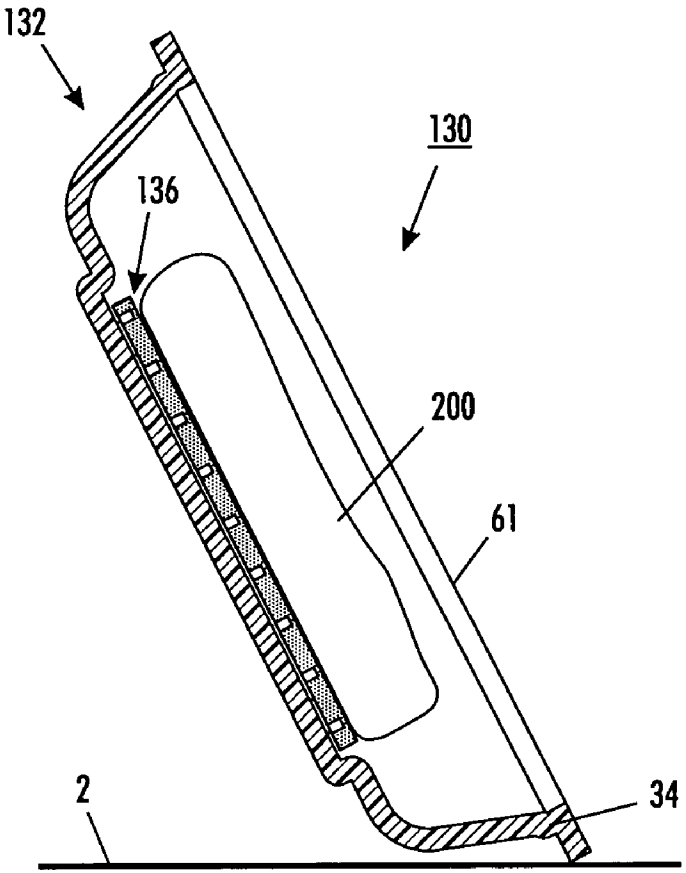
FIG. 9B is a cross-sectional view of a meat tray that does absorb juices quickly enough and/or does retain juices when tilted at an angle to the horizontal direction.
Figure 9A:
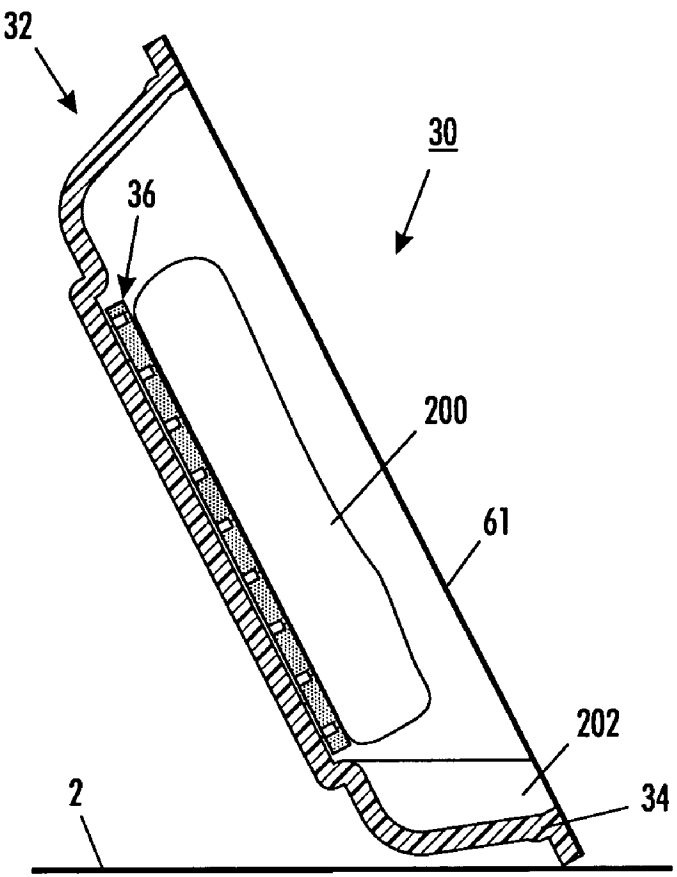
FIG. 9A is a cross-sectional view of a meat tray that does not absorb juices quickly enough and/or does not retain juices when tilted at an angle to the horizontal direction.
Figure 10:
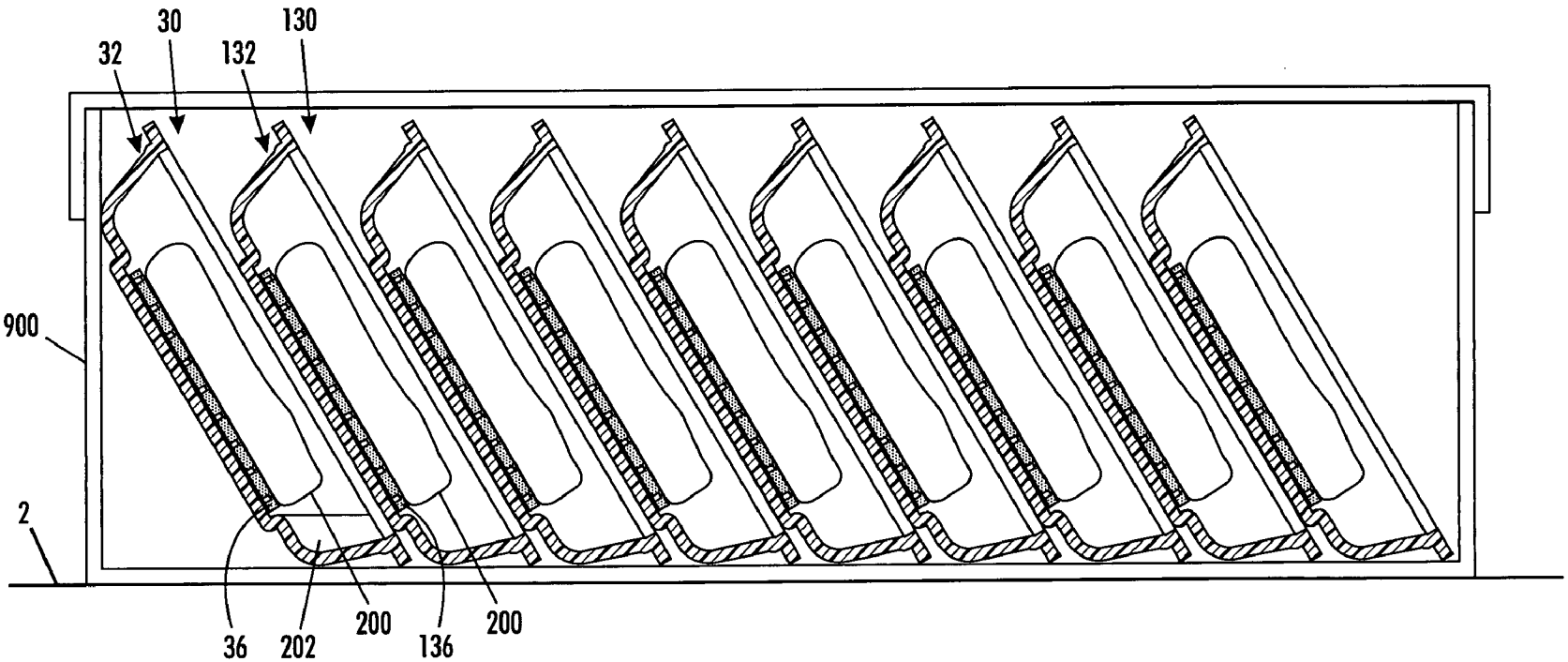
FIG. 10 is a cross sectional view of a shipping container containing one tray as depicted in FIG. 9A, and the remaining trays as depicted in FIG. 9B, all tilted at an angle to maximize the number of trays packed in the shipping container.

FIG. 9A is a cross-sectional view of a meat tray that does not absorb juices quickly enough and/or does not retain juices when tilted at an angle to the horizontal direction. FIG. 9B is a cross-sectional view of a meat tray that does absorb juices quickly enough and/or does retain juices when tilted at an angle to the horizontal direction. FIG. 10 is a cross sectional view of a shipping container containing one tray as depicted in FIG. 9A, and the remaining trays as depicted in FIG. 9B, all tilted at an angle to maximize the number of trays packed in the shipping container.

Referring to FIG. 9A, package 30 is shown tilted at an angle to the horizontal plane 2, wherein such angle is typical of the angle at which multiple packages are placed in a shipping container as shown in FIG. 10, preferably so that upwardly extending lip 34 is approximately parallel to horizontal plane 2. Package 30 comprises a juice absorbing pad 36, which does not absorb juices quickly enough, i.e. juice absorbing pad 36 does not absorb juice within the time from when meat 200 is first placed upon pad 36, until the time that over-wrapping film 61 is wrapped over the top of tray 32, and package 30 is placed in a shipping container at an angle as shown in FIG. 10. In a typical production meat packing operation, such time may vary from between about 1 minute to about 10 minutes.

As a consequence of such insufficient rate of absorption, or as a consequence of pad 36 being unable to completely retain meat juice therein when tilted, juice 202 forms a pool at the lowermost portion of package 30 at such time (or soon thereafter) package 30 is tilted on edge. Such a condition is unsatisfactory, because during shipping (and/or prior to the contents being frozen), there is some risk that pooled juice 202 will leak out of the package, causing messy and unsanitary conditions in the shipping container. Also, at such time when the package is placed in a display case for retail sale, it will have an unsatisfactory appearance.

Referring to FIG. 9B in contrast, package 130 comprises juice absorbing pad 136, joined to tray 132. Pad 136 does absorb juices quickly enough (i.e. in the time between placement of meat therein, and the time between angular placement in shipping container 900 of FIG. 10) and also does retain juices when tilted at an angle to the horizontal direction.

To provide such a meat package, applicant has modified the nature of the open cell absorbent pad 136 to more quickly absorb the meat purge in a vertical or nearly vertical position. In accordance with the present invention, an open cell absorbent pad 136 is provided, which has a high rate of absorption of liquids; and a meat package 130 is provided comprising such a high absorption rate pad 136, which will absorb meat juices quickly after meat is placed therein, and which will retain such juices when such package is placed at an angle to the horizontal plane.

Figure 11:
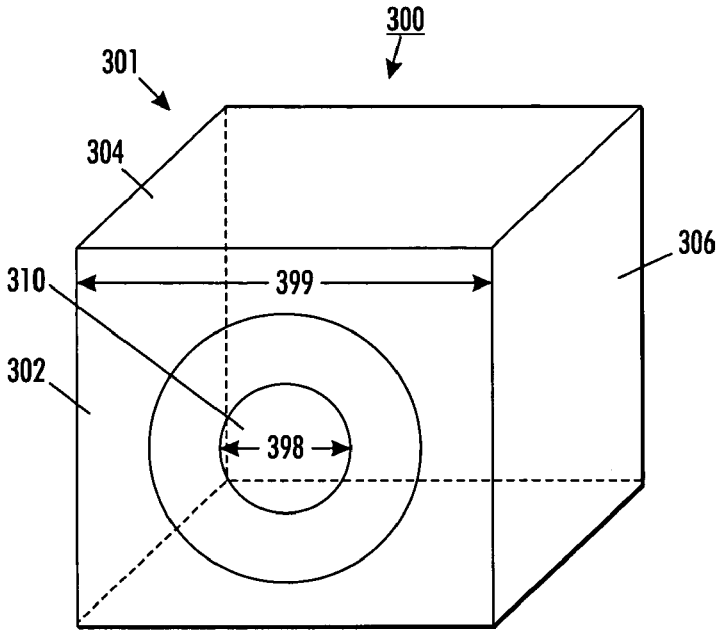
FIG. 11 is a schematic representation of an open cell within the foam of the present invention, comprising a pore therein.

FIG. 11 is a schematic representation of an open cell within the foam of the present invention, comprising a pore therein. Referring to FIG. 11, for the sake of simplicity of illustration, cell 300 is depicted as having a cubic shape. In actuality, cell 300 may have other shapes, and in most cases, foam cell has a shape more closely approximated by a dodecahedron having a characteristic dimension 399 along an axis there-through.

Cell 300 comprises a cell wall 301 comprised of a plurality of cell facets or walls 302, 304, 306, etc. In a circumstance wherein cell 300 has a dodecahedral shape, cell 300 has twelve facets. Facets 302, 304, 306, etc. are shared with neighboring cells (not shown), which in turn share facets with other neighboring cells, thereby making up the continuum or matrix of open cells forming the open cell foam, and eventually terminating at the outer surface, or "skin" of such foam.

Facet 302 of cell 300 comprises a pore 310 having an approximately circular or elliptical shape having a characteristic size 398. Thus cell 300 is in communication with its neighboring cell (not shown) through pore 310, which also shares facet 302. Fluids, i.e. liquids and/or gases, and/or chemical species may flow through pore 310 from cell 300 to its neighbor sharing facet 302, through the action of a pressure gradient, a concentration gradient, a capillary force, an electrostatic field, a magnetic field, or other effect, depending upon the properties of the particular fluid and the properties of the foam. For significant flow of fluid to occur through the foam, at least one of other facets 304, 306, and/or others not shown preferably comprise a pore therein, so that other neighboring cells are in communication therethrough with cell 300.

In order to obtain significant absorption it is preferable that at least about 50% of the cells within the cell matrix be interconnected through pores. Absorption increases as the proportion of open cell content increases. Thus, preferably at least about 65 percent, and more preferably, about 80 percent of the cells within the cell matrix be interconnected through pores.

EEPERIMENTAL

The applicant has discovered that the rate of liquid absorption, as well as the volume of absorption for an open cell polystyrene foam can be significantly increased by controlling and varying the ratio of the cell size 399 to the open cell foam pore size 398. By optimizing the ratio of cell size to pore size, the applicant has produced an open cell foam having superior properties with respect to the rate of liquid absorption into the open cell foam, the total volume of absorption within the open cell foam, and subsequent retention of liquid therein when a sheet of such foam is oriented at an angle to the horizontal plane.

A series of open cell foam liquid absorbent pad samples were produced with varying ratios of pore size and cell size. Cell "diameter" (i.e. the equivalent of cell size 399 of FIG. 11) was measured using a Boreal Microscope and Motic Software available from Fisher Scientific of Farlawn, N.J. The percentage of open cells was measured using an air comparison pycnometer obtained from Quantachrome Inc., Boynton Beach Fla.

Pore size was measured using the Washburn Equation, which is described on page 9 in *Absorbent Technology* edited by Chatterjee and Gupta published by Elsevier in 2002, and which reads as follows:

$$\ln\{1-L/L_{eq}\}^{-1}-L/L_{eq}=B_l t$$

where:

L=capillary rise height at time=t $L_{eq}$=capillary rise height at equilibrium, and $$B_l=r_c^2\rho_l g/8nL_{eq}$$

where $r_c^2$=pore radius squared $\rho_l$=density of liquid g=gravitational constant and n=liquid viscosity Data for the cell morphology of one preferred absorbent pad sample, as well as two prior art absorbent pad samples are shown in Table 1.

TABLE 1

CELL MORPHOLOGY OF SELECTED OPEN CELL FOAM PADS.

| SAMPLE | CELL DIAMETER (microns) | PORE SIZE (microns) | % OPEN CELLS | RATIO OF CELL DIAMETER TO PORE DIAMETER |
|---|---|---|---|---|
| A | 150 | 4 | 74 | 37.5 |
| B | 250 | 13.2 | 72 | 18.9 |
| C | 50 | 10.5 | 87 | 4.8 |

Sample A is representative of an open cell pad described previously in the applicant's pending application U.S. Ser. No. 10/300,256, filed Nov. 20, 2002.

Sample B is a commercial sample of open cell absorbent foam obtained from Vitembal located in Avignon France.

Sample C is a sample of the preferred open cell foam made in accordance with the present invention.

Vertical Absorption Capacity

Figure 12:
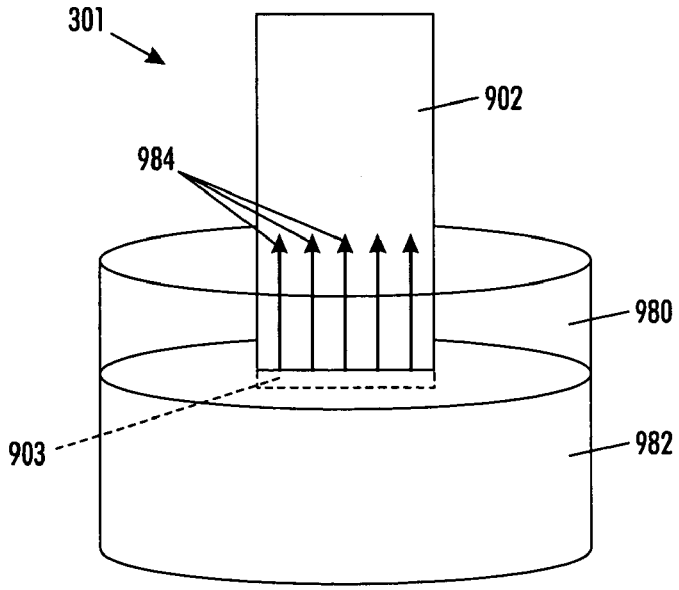
FIG. 12 is a schematic representation of the apparatus and the placement of a foam pad sample therein for measuring vertical rise absorption capacity.

The absorption capacity for each sample in Table 1 was characterized by measuring the amount of water absorbed by each sample after 30 minutes in the vertical direction. FIG. 12 is a schematic representation of the apparatus and the placement of a foam pad sample therein for measuring vertical rise absorption capacity. Referring to FIG. 12, a sample 902 of foam pad was cut by a razor or other sharp tool to a preferred size. In the tests described herein, sample 902 was cut in a rectangular shape, 1.25 inches wide by 5.0 inches long. The cut sample 902 was then precisely weighed on an analytical balance.

A beaker 980 containing a liquid 982 having substantially the same absorption properties as meat juice was placed beneath the sample, which was held in a fixture (not shown). In the experiments performed, liquid 982 was water. Sample 902 was lowered until the lower edge 903 thereof was just slightly immersed in water 982. Water 982 rises up through foam sample 902 through capillary action as indicated by arrows 984. The sample 902 was held in this position for 30 minutes, and the weight of the sample 902 and absorbed water therein was quickly weighed after removal from the fixture, thereby enabling, by subtraction, the calculation of the weight of the absorbed water therein.

The results for samples A,B, and C described previously are shown in Table 2. The data in Table 2 represents an average of three runs.

TABLE 2

30 MINUTE VERTICAL RISE ABSORPTION CAPACITY OF SELECTED OPEN CELL FOAM PADS.

| SAMPLE | ABSORPTION: GRAMS OF WATER ABSORBED/ GRAM OF ORIGINAL SAMPLE |
|---|---|
| A | 0.82 |
| B | 2.20 |
| C | 6.70 |

It is clear that Samples C, made in accordance with the present invention, exhibits significantly improved vertical absorption capacity when compared to Samples A as previously described in this specification, as well as the Vitembal prior art foam pad, sample B. Sample C of the present invention is superior to Sample A in vertical absorption capacity by approximately a factor of 8, and Sample C is superior to Sample A in vertical absorption capacity by approximately a factor of 3.

Horizontal Absorption Rate

Samples A and C as previously described herein were tested for horizontal absorption rate. The measurement of horizontal absorption rate was conducted by immersing a 4 inch by 4 inch piece of each Sample A and Sample C in water. Dry weights of each sample were measured before immersion, and the rate of weight increase of each, i.e. the rate of water absorption of each was measured as a function of time. The results of this horizontal absorption rate test are shown in Table 3. The data in Table 2 represents an average of three runs.

TABLE 3

RATE OF WATER ABSORPTION OF HORIZONTALLY POSITIONED SAMPLE A AND SAMPLE C OPEN CELL FOAM PADS.

| TIME (seconds) | SAMPLE A WEIGHT GAIN (grams) | SAMPLE C WEIGHT GAIN (grams) | RATIO OF ABSORPTION RATE OF SAMPLE C TO ABSORPTION RATE OF SAMPLE A |
|---|---|---|---|
| 0 | 0 | 0 | 0 |
| 15 | 5.2 | 13.7 | 2.6 |
| 30 | 5.9 | 14.0 | 2.4 |
| 60 | 6.0 | 14.1 | 2.35 |
| 120 | 6.1 | 14.6 | 2.4 |

The improved open cell foam pad of Sample C of the present invention absorbs water at a rate between about 2.35 to about 2.6 times the rate of the previously described pad of Sample A.

Angular Absorption Rate

Figure 13:
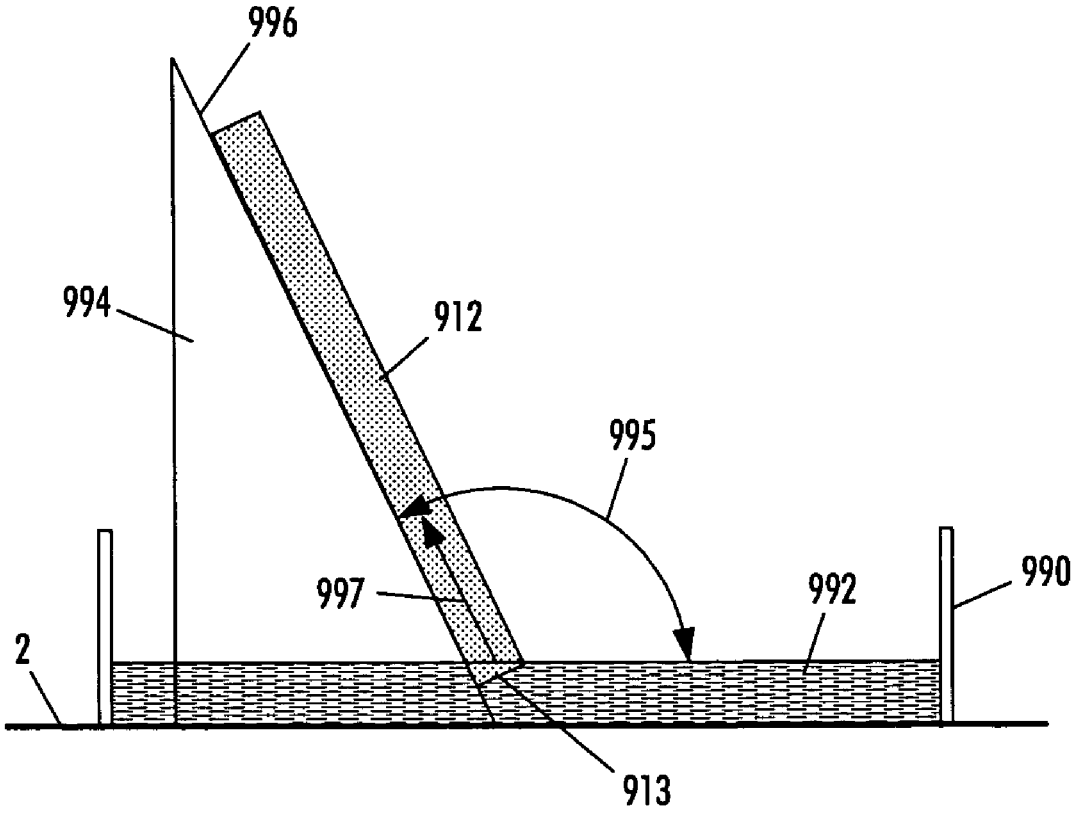
FIG. 13 is a schematic representation of the apparatus and the placement of a foam pad sample therein for measuring such an "angular absorption rate."

An additional test was performed to measure the improved absorbency of the foam pad of the present invention when such pad is disposed at an angle to the horizontal plane. This test stimulates the conditions when the finished package is placed at an angle into a corrugated box container for shipping as shown in FIG. 10. FIG. 13 is a schematic representation of the apparatus and the placement of a foam pad sample therein for measuring such an "angular absorption rate." Referring to FIG. 13, a sample 912 of foam pad was cut by a razor or other sharp tool to a preferred size. In the tests described herein, sample 912 was cut in a rectangular shape, 1.5 inches wide by 6 inches long. The cut sample 912 was then precisely weighed on an analytical balance.

A shallow beaker 990 containing a liquid 992 having substantially the same absorption properties as meat juice was provided, in which was placed a fixture 994 having an angulary shape 996 disposed at an angle 995 of approximately 115 degrees to the horizontal plane 2. In the experiments performed, liquid 992 was water. Sample 912 was placed upon fixture 994 until the lower edge 913 thereof was just slightly immersed in water 992. Water 992 rises up through foam sample 912 through capillary action as indicated by arrow 997. The sample 912 was held in this position for brief periods of time, and the weight of the sample 902 and absorbed water therein was quickly weighed after removal from the fixture, thereby enabling, by subtraction, the calculation of the weight of the absorbed water therein and the rate of water absorption as a function of time.

The results of this angular absorption rate test are shown in Table 4.

TABLE 4

RATE OF WATER ABSORPTION OF SELECTED SAMPLE A AND SAMPLE C OPEN CELL FOAM PADS POSITIONED 115 DEGREES FROM HORIZONTAL.

| TIME SECONDS | SAMPLE A WEIGHT GAIN GRAMS | SAMPLE C WEIGHT GAIN GRAMS | RATIO C/A |
|---|---|---|---|
| 0 | 0 | 0 | 0 |
| 15 | 1.7 | 7.5 | 4.4 |
| 30 | 2.1 | 8.6 | 4.1 |
| 60 | 2.7 | 10.1 | 3.7 |
| 120 | 3.3 | 11.7 | 3.6 |
| 240 | 3.9 | 13.7 | 3.5 |

The improved open cell foam pad of Sample C of the present invention absorbs water at a rate of between about 3.5 to about 4.4 times the rate of the previously described pad of Sample A, when placed at a 115 degree angle to the horizontal.

As was stated previously, the applicant has discovered that the rate of liquid absorption, as well as the volume of absorption for an open cell polystyrene foam can be significantly increased by producing an open cell foam having an optimal ratio of cell size to pore size. The applicant has produced such an open cell foam having superior properties with respect to the rate of liquid absorption into the open cell foam, the total volume of absorption within the open cell foam, and subsequent retention of liquid therein when a sheet of such foam is oriented at an angle to the horizontal plane.

It can be seen that for the prior art open cell foams shown in Table 1, the ratio of cell size to pore size is between about 19:1 (Sample B) and about 40:1 (Sample A). To produce open cell foams with improved rates of liquid absorption and total volumes of liquid absorption, the ratio of cell size to pore size is preferably between about 1:1 and about 10:1. Superior foams are produced when the ratio of cell size to pore size is preferably between about 1:1 and about 6:1. The applicant believes that the highest rates of liquid absorption and total volumes of liquid absorption occur when the ratio of cell size to pore size is about 1:1 to about 4:1.

Without wishing to bound to any particular theory, applicant believes that the higher rates of liquid absorption and higher total volumes of liquid absorption is a result of increased capillary pressure developed within the open cell structure which leads to trapped air leaving the structure at a higher rate. Applicant further believes that an additional benefit is obtained when a higher proportion of open cells is present in the foam, and that a proportion of open cells greater than about 80 percent provides a foam with superior properties as compared to foams of about 75 percent or less open cells. It can be seen that one preferred embodiment, Sample A shown in Table 1, has 87 percent open cells.

It is, therefore, apparent that there has been provided, in accordance with the present invention, a highly absorptive open cell foam having a ratio of cell size to pore size of between about 1 and about 4. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A highly absorptive open cell polymer foam, wherein:

(a) said polymer foam is of between 50 to about 90 percent open cells;

(b) said polymer foam has an average cell diameter of between about 1 and about 10 thousandths of an inch;

(c) said polymer foam has a ratio of cell size to pore size of about 1 to about 10;

(d) said polymer foam has a density of between 1 and about 20 pounds per cubic foot; and (e) said polymer foam has a contact angle when placed with water of about 0 to 70 degrees.

2. The open cell polymer foam as recited in claim 1, wherein said polymer foam absorbs liquid in an amount greater than about 30% of the available void volume within said polymer foam.

3. The open cell polymer foam as recited in claim 1, wherein said polymer foam has a thickness of between about 25 and about 350 thousandths of an inch.

4. The open cell polymer foam as recited in claim 1, wherein said polymer foam is comprised of between about 80 to about 90 percent open cells.

5. The open cell polymer foam as recited in claim 1, wherein said polymer foam has a ratio of cell size to pore size of about 1 to about 6.

6. The open cell polymer foam as recited in claim 5, wherein said polymer foam has a ratio of cell size to pore size of about 1 to about 4.

7. The open cell polymer foam as recited in claim 6, wherein said polymer foam is comprised of between about 80 to about 90 percent open cells.

8. The open cell polymer foam as recited in claim 1, wherein said polymer foam comprises between about 0.5 and about 15 weight percent of surfactant.

9. A food package comprising a tray having a bottom bounded by an upwardly extending lip around the perimeter of said bottom and a liquid-absorbing pad comprised of polymer foam joined to said bottom of said tray, wherein:

(a) said polymer foam is comprised of between 50 to about 90 percent open cells;

(b) said polymer foam has an average cell diameter of between about 1 and about 10 thousandths of an inch;

(c) said polymer foam has a ratio of cell size to pore size of about 1 to about 10;

(d) said polymer foam has a density of between 1 and about 20 pounds per cubic foot; and (e) said polymer foam has a contact angle when placed with water of about 0 to 70 degrees.

10. The food package as recited in claim 9, wherein said polymer foam absorbs liquid in an amount greater than about 30% of the available void volume within said polymer foam.

11. The food package as recited in claim 9, wherein said polymer foam has a thickness of between about 25 and about 350 thousandths of an inch.

12. The food package as recited in claim 9, wherein said polymer foam is comprised of between about 80 to about 90 percent open cells.

13. The food package as recited in claim 9, wherein said polymer foam has a ratio of cell size to pore size of about 1 to about 6.

14. The food package as recited in claim 13, wherein said polymer foam has a ratio of cell size to pore size of about 1 to about 4.

15. The food package as recited in claim 14, wherein said polymer foam is comprised of between about 80 to about 90 percent open cells.

16. The food package as recited in claim 9, wherein said tray is comprised of at least 50 weight percent of polymer.

17. The food package as recited in claim 16, wherein said tray further comprises a step disposed around said perimeter of said bottom and wherein said step and said bottom form a countersunk volume within said tray.

18. The food package as recited in claim 9, wherein said tray is comprised of a gas permeable polymer resin.

19. The food package as recited in claim 9, wherein said tray is comprised of a gas impermeable polymer resin.

20. The food package as recited in claim 9 wherein said liquid absorbing pad is joined to said bottom of said tray with adhesive.

21. The food package as recited in claim 9 wherein said liquid absorbing pad is laminated to said bottom of said tray.

* * * * *